US005611275A

United States Patent [19]

Iijima et al.

[11] Patent Number: 5,611,275

[45] Date of Patent: Mar. 18, 1997

[54] WIDTH ADJUSTING DEVICE AND METHOD FOR A PAPER WEB

[75] Inventors: Takashi Iijima, Tokosuka; Hideo Ohta, Tokyo, both of Japan

[73] Assignee: Kabushikigaisha Tokyo Kikai Seisakusho, Tokyo, Japan

[21] Appl. No.: 485,130

[22] Filed: Jun. 7, 1995

Related U.S. Application Data

[62] Division of Ser. No. 291,470, Aug. 17, 1994, Pat. No. 5,487,335, which is a continuation of Ser. No. 889,906, May 29, 1992, abandoned.

[30] Foreign Application Priority Data

Dec. 26, 1991 [JP] Japan ..... 3-357580

[51] Int. Cl.[6] ..... B41F 5/06

[52] U.S. Cl. ..... 101/181; 101/228; 101/485

[58] Field of Search ..... 101/181, 228, 101/219, 138, 139, 143, 221, 450.1, 451, 485, 484; 226/3, 15, 17, 34, 45, 185, 186, 189, 190

[56] References Cited

U.S. PATENT DOCUMENTS

| | | | |
|---|---|---|---|
| 3,098,432 | 7/1963 | Bechtold et al. | 101/181 |
| 3,147,898 | 9/1964 | Huck | 226/17 |
| 3,467,008 | 9/1969 | Domotor | 101/142 |
| 3,982,327 | 9/1976 | Kurie et al. | 34/156 |
| 4,303,189 | 12/1981 | Wiley et al. | 226/174 |
| 4,696,230 | 9/1987 | Barkley | 101/181 |
| 4,831,926 | 5/1989 | Bowman et al. | 101/138 |
| 5,152,222 | 10/1992 | Okamura et al. | 101/179 |
| 5,152,522 | 10/1992 | Yamashita | 271/264 |

OTHER PUBLICATIONS

IFRA Newspaper Techniques English Edition, pp. 64–73, published by INCA–FIEJ Research Association, Apr. 1988.

*Primary Examiner*—J. Reed Fisher
*Attorney, Agent, or Firm*—Foley & Lardner

[57] ABSTRACT

A web width adjusting device can adequately adjust the width of paper web which is travelled through at least two printing sections. The travelling web is sandwitched by a pair of contact means including a plurality of contact members which are aligned in parallel to the axis of cylinders for driving the paper web. The contact members of one alignment are alternatively in contact with the web surface with respect to the other alignment.

19 Claims, 5 Drawing Sheets

WIDTH ADJUSTING DEVICE AND METHOD FOR A PAPER WEB

This application is a divisional of application Ser. No. 08/291,470, filed Aug. 17, 1994 now U.S. Pat. No. 5,487, 335; which is a Rule 62 continuation of Ser. No. 07/889,906, filed May 29, 1992, now abandoned.

BACKGROUND OF THE INVENTION

1. Field of the Invention

The present invention generally relates to a width adjusting device for a paper web, which adjusts the width of the paper web for a printing system prior to a printing section of a rotary press. More particularly, the present invention relates to a lithographic rotary press which is equipped with at least one width adjusting device and a plurality of printing sections through which the paper web is successively passed.

2. Description of the Prior Art

A typically conventional lithographic rotary press adapted for a color printing system is, for example, shown in FIG. 3. This conventional lithographic press printing system comprises a plurality of printing sections P each of which includes two pairs of a combination of a plate cylinder PC and a blanket cylinder BC. The blanket cylinders BC of each printing section P are vertically arranged to be in contact with each other. In this conventional printing system, four sets of the printing sections P are horizontally arranged in parallel as shown in FIG. 3. A paper web W is horizontally fed into the four sets so as to pass the paper web W through the pressed space between four pairs of blanket cylinders BC, BC, to print on both surfaces of the paper web W.

Another conventional lithographic press for a color printing system is shown in FIG. 4 wherein four printing sets, each of which is composed of a plate cylinder PC and a blanket cylinder BC, are radially arranged about an impression cylinder IC acting as a common center cylinder. The blanket cylinders BC are each in contact with the impression cylinder IC to form the printing section P. A paper web W travels around the circumference of the impression cylinder IC so that the paper web W is successively passed through the four printing sections P defined between the blanket cylinders BC and the impression cylinder IC, thereby printing on one side surface of the paper web W.

In recent years, many newspaper publishers have progressed to print newspaper in color inks and thus have demanded that such color printing be performed on many pages at a high speed and in a limited printing space.

In order to meet such demands, other conventional offset lithographic press color printing systems, is shown in FIG. 5 and FIG 6. Each printing section P includes two sets of a blanket cylinder BC and a plate cylinder PC which are symmetrically arranged so as to bring the blanket cylinders BC into contact with each other. A paper web W is vertically passed through the four printing sections P to print on both surfaces of the paper web W in the same manner as the above described systems. This type printing system is for example shown in "IFRA Newspaper Techniques English Edition", pp. 64 to pp 73; April, 1988 published by INCA-FIEJ Research Association.

The paper web which is printed on is generally produced in such a manner that pulp fibers are mechanically cut and broken into fine particles; dispersed in water; dehydrated and dried; and finally adhered by hydrogen-bond to form a paper sheet. Under moisture condition, each of the pulp fibers tends to extend a little less than 1 percent in its longitudinal direction and 20 to 30 percent in its redial direction. Thus, the paper web is extended in its longitudinal and width directions by dampening and/or watering operations. Most of the pulp fibers of a general mechanically produced paper web are orientated in the longitudinal direction of the paper web, so that the paper web is remarkably extended in its width direction when exposed to moisture.

In the lithographic printing systems employing dampening or watering operation in the printing section, the paper web is swelled by the dampening water. Therefore, the printed pattern on the paper web is also deformed in response to the swell of the paper web. Accordingly, in printing systems including at least two lithographic printing sections, each of which is associated with the dampening means for successively printing color images on the same paper web, the printed images formed at the first printing section is not correctly aligned with the images formed at the second and later printing sections. Accordingly, printed materials having poor quality are produced.

BRIEF SUMMARY OF THE INVENTION

Therefore, it is a primary object of the invention to provide an improved width adjusting device for a paper web, which can be associated with a lithographic color-printing system including at least two printing sections using dampening means to successively print image on the same paper web, and which can adjust the width of the paper web to correctly align the former printed image with the succeeding printing image.

Another object of the present invention is to provide an improved width adjusting method for a paper web to successively print an image on the same paper web without any sheering occuring.

Other object of the present invention is to provide a lithographic color-printing system whose printing sections are each equipped with a paper width adjusting means to produce high quality printed material.

To accomplish the above described objects, a web width adjusting device according to the present invention comprises a pair of contact means between which a paper web is passed. Each of the contact means includes a plurality of contact members which are aligned in parallel to the axis of cylinders for driving the paper web. The contact members of one alignment are alternatively in contact with the web surface with respect to the other alignment.

Another aspect according to the present invention is characterized in that a lithographic printing system comprises a plurality of printing sections along a paper web travelling line, and a plurality of web width adjusting devices each of which is arranged prior to a printing section.

A further aspect according to the present invention is characterized in that a web width adjusting method comprises a wave forming step by brining a plurality contact members alternatively in contact with one surface and the other surface of the paper web.

Other objects and features of the invention will be apparent from a reading of the following description of the disclosure found in the accompanying drawings and the novelty thereof pointed out in the appended claims.

DETAILED DESCRIPTION OF THE PREFERRED EMBODIMENT

One preferred embodiment, as the first embodiment, of the present invention will be described in detail with reference to the accompanying drawings FIG. 1 to FIG. 2.

Figure 2:
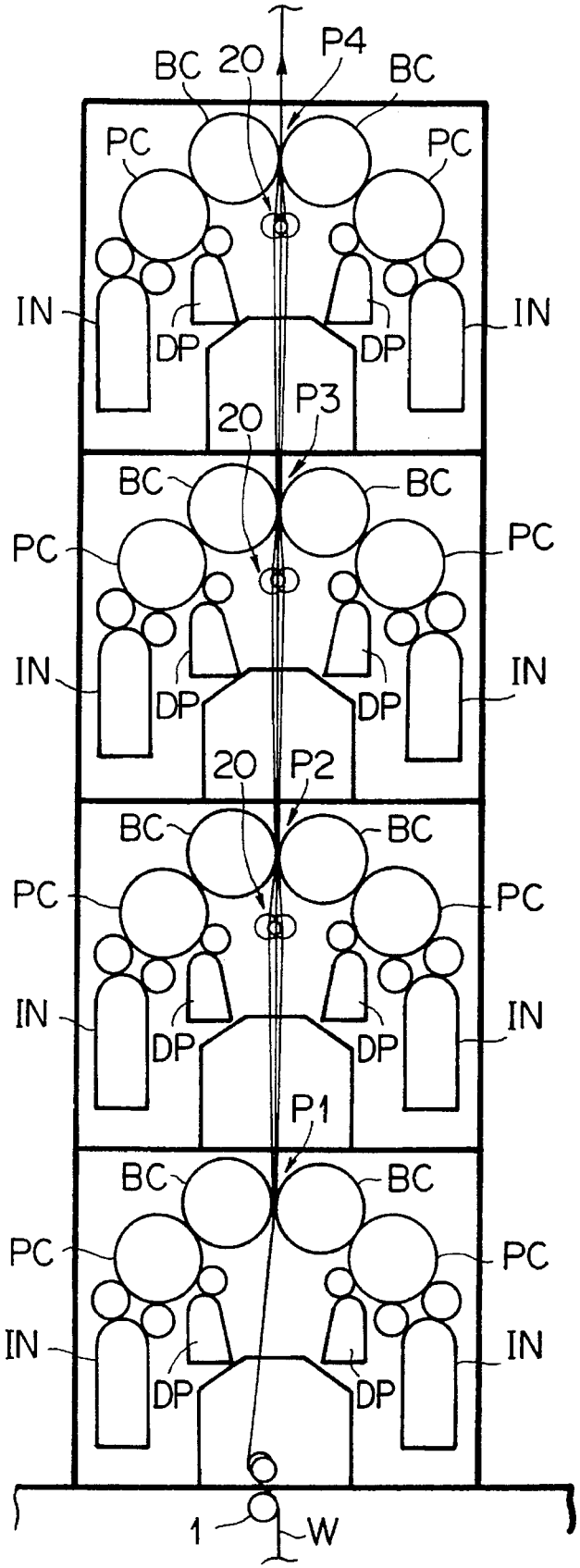
FIG. 2 is a schematic illustration showing an overall construction of a lithographic rotary press which is associated with a plurality of web width adjusting devices according to the present invention.
Figure 3:
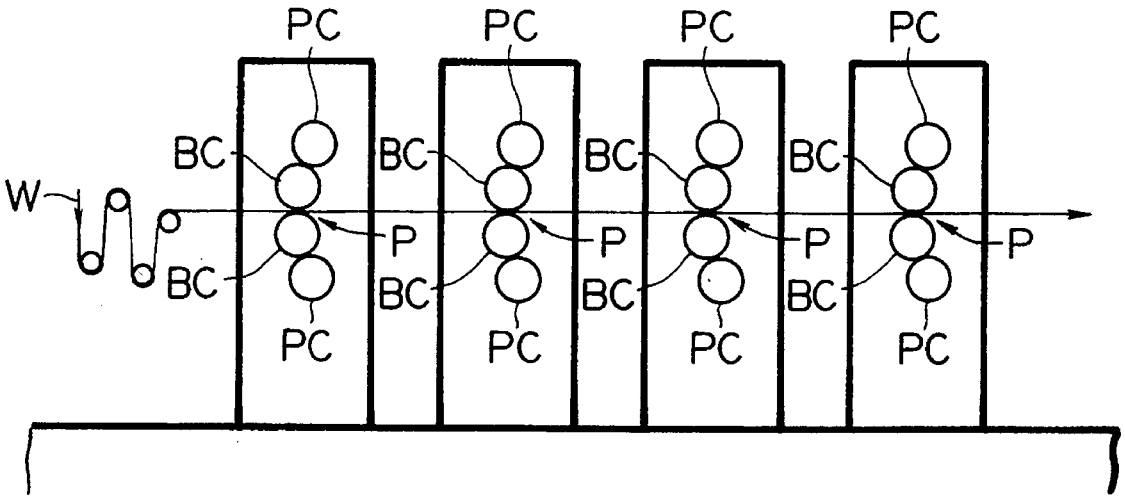
FIG. 3 PRIOR ART
FIG. 3 is schematic illustration showing one conventional configuration of a commonly used lithographic rotary press.
Figure 4:
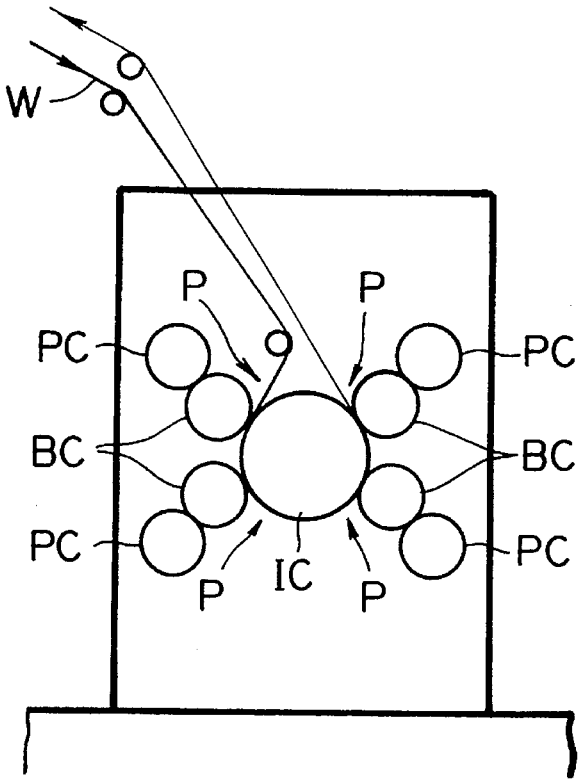
FIG. 4 PRIOR ART
FIG. 4 is schematic illustration showing another conventional configuration of a commonly used lithographic rotary press.
Figure 5:
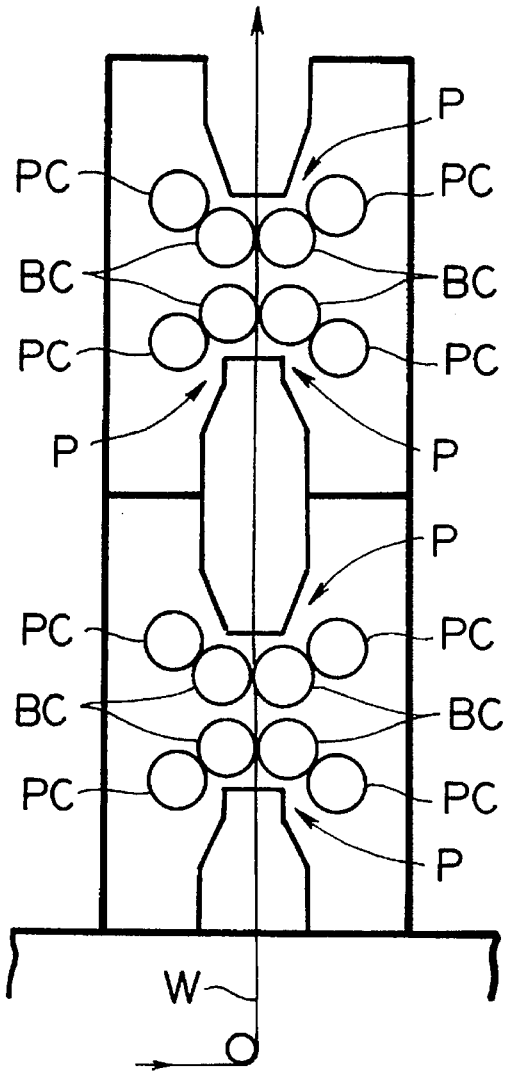
FIG. 5 PRIOR ART
FIG. 5 is schematic illustration showing another conventional configuration of a commonly used lithographic rotary press.
Figure 6:
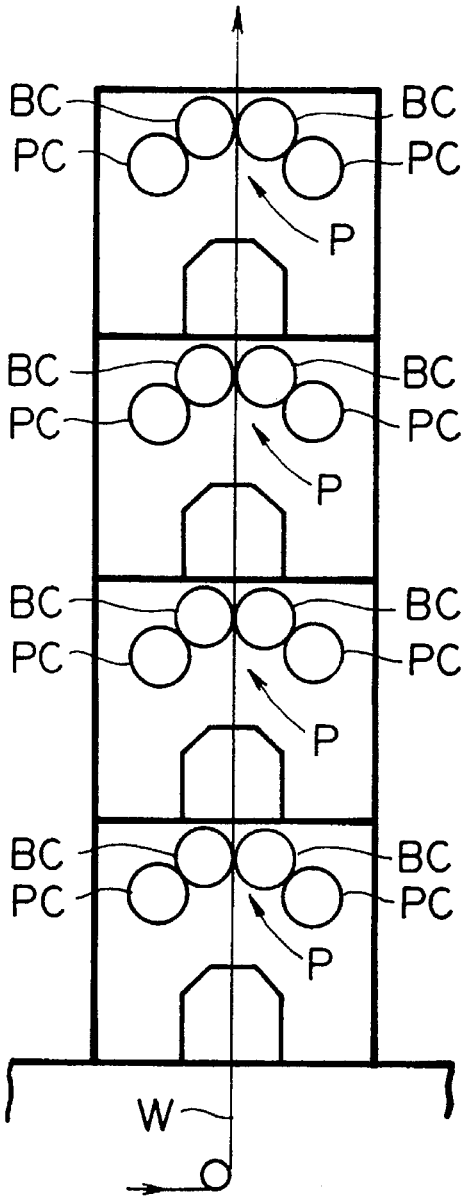
FIG. 6 PRIOR ART
FIG. 6 is schematic illustration showing another conventional configuration of a commonly used lithographic rotary press.

In FIG. 2, there is shown an overall constitution of a lithographic rotary press which comprises four printing sections P1. P2, P3 and P4 vertically arranged in the same manner as the above a described conventional color-printing lithographic rotary press shown in FIG. 6. Each printing section includes two sets of a blanket cylinder BC and a plate cylinder PC which are symmetrically arranged so as to bring the blanket cylinders BC into contact with each other. A paper web W is vertically travelled from the first printing section P1 to the fourth printing section P4. Further, the rotary press shown in FIG. 2 comprises a plurality of web width adjusting devices 20, described hereafter in greater detail.

In FIG. 2, IN and DP represent an inking unit and a dampening unit, respectively.

Figure 1:
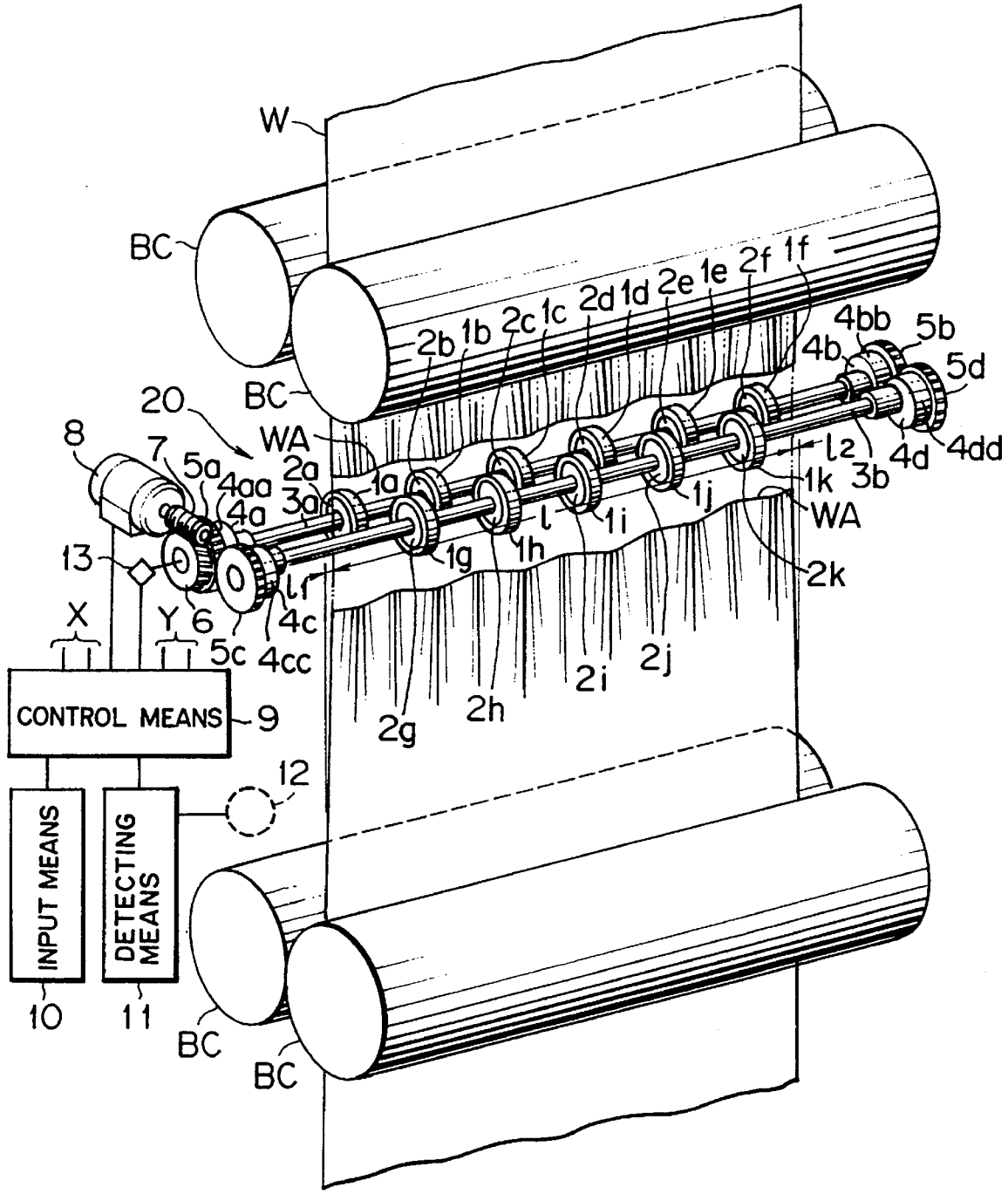
FIG. 1 is a schematic perspective view showing the first embodiment of a web width adjusting device according to the present invention.

The web width adjusting device 20 is typically shown in FIG. 1, wherein the device 20 comprises a pair of contact means between which the paper web W is travelled. Each of the contact means includes a plurality of contact members. This embodiment uses contact rollers for these contact members. In detail, the contact rollers are respectively composed of contact surfaces 1*a*, 1*b*, 1*c*, 1*d*, 1*e* and 1*f*; and 1*g*, 1*h*, 1*i*, 1*j*, and 1*k*, which are circumferential surfaces of roller members 2*a*, 2*b*, 2*c*, 2*d*, 2*e* and 2*f*; and 2*g*, 2*h*, 2*i*, 2*j* and 2*k*. In a first series of the roller members 2*a* to 2*f*, the roller numbers are isolated from each other at a regular interval and rotatably assembled on a first shaft 3*a*. In a second series of the roller members 2*g* to 2*k*, the roller numbers are also isolated from each other at a regular interval and rotatably assembled on a second shaft 3*b*. The roller members 2*g* to 2*k* of the second series are respectively shifted to lie at a half of the interval between the roller members of the first series, so that each roller member of the second series is positioned at the center of two roller members of the first series as shown in FIG. 1.

The first and second shafts 3*a* and 3*b* are each eccentrically mounted at their both ends in eccentric sleeves 4*a* and 4*b*; and 4*c* and 4*d*, respectively. These eccentric sleeves 4*a* to 4*d* are rotatably mounted on a frame, not shown, through end members 4*aa*, 4*bb*, 4*cc*, and 4*dd*. Further, the eccentric sleeves 4*a* to 4*d* are respectively provided at their ends with end gears 5*a*, 5*b*, 5*c* and 5*d* which are rotated with their connected eccentric sleeves 4*a* to 4*d*. The end gears 5*a* and 5*c*, at the same ends, are meshingly engaged with each other, and the end gears 5*b* and 5*d*, at the other ends, are also meshed with each other.

The eccentric sleeve 4*a* is further provided with a worm wheel 6 which is integrally rotated with the eccentric sleeve 4*a*. The worm wheel 6 is meshed with a worm 7 fixed to a shaft of a driving means 8.

The driving means 8 is controlled by a control means 9 which is electrically operated by an input means 10 such as a key board and a detecting means 11 by which various operation informations such as speed of a main motor 12 representing travelling speed of the paper web W. The control means 9 is further electrically connected to another detecting means 13 for detecting rotational phase of the driving means 8 and the eccentric sleeve 4*a* (4*b*, 4*c*, 4*d*). Further the control means 9 is connected to the driving means and to the detecting means for detecting rotational phase of the driving means and the eccentric sleeve of the other web width adjusting means, not shown, through lines X and Y, respectively.

Alternatively, the control means 9 may be communicated with these detecting means and driving means by any conventional radio means.

Figure 7:
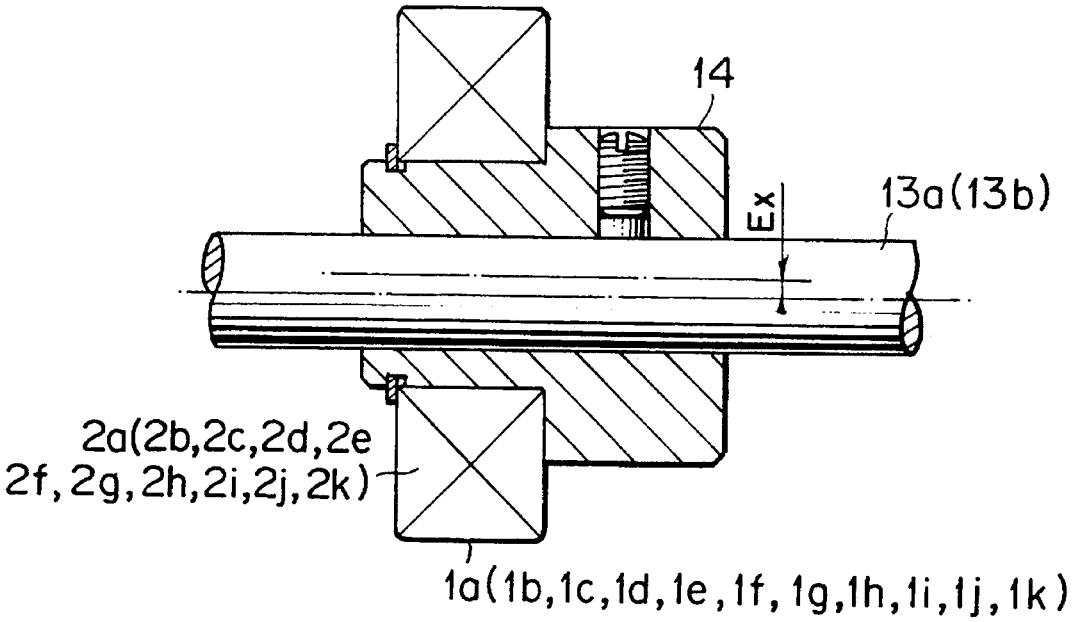
FIG. 7 is a cross sectional view showing a second embodiment of a web width adjusting device according to the present invention.

FIG. 7 shows the second embodiment of a web width adjusting device according to the present invention, wherein another eccentric member 14 is used for positioning contact means to the surface of travelling paper web W.

In the first embodiment shown in FIG. 1, the shafts 3*a* and 3*b* are moved by rotating motion of the eccentric sleeves 4*a* to 4*d* supporting the shafts 3*a* and 3*b*, and thus the roller members 2*a* to 2*k* assembled on the shafts 3*a* and 3*b* are simultaneously moved. On the other hand, the second embodiment shown in FIG. 7 employs the eccentric member 14 which allows the roller members 2*a* to 2*k* to be eccentrically supported by the shafts 3*a* and 3*b* independently, and therefore the contact surfaces of the roller members 2*a* to 2*k* can be independently positioned to the surface of the travelling paper web W.

Figure 8:
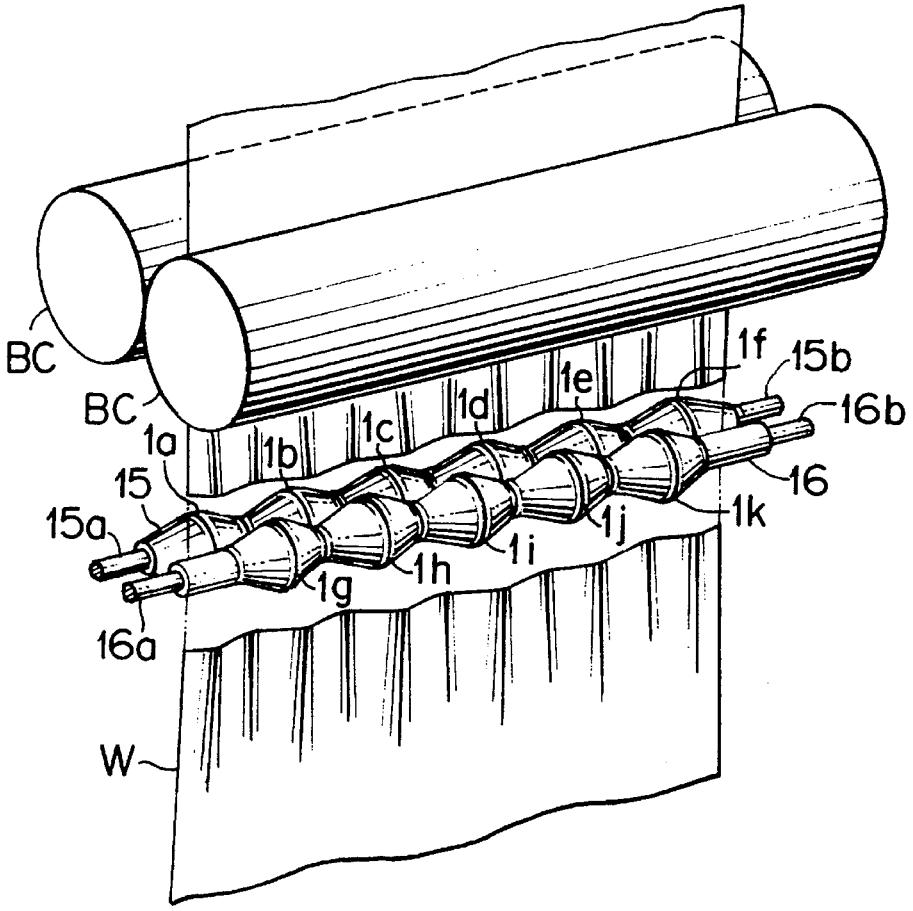
FIG. 8 is a schematic perspective view showing a third embodiment of a web width adjusting device according to the present invention.

FIG. 8 shows the third embodiment of a web width adjusting device according to the present invention, where a pair of knaggy rollers 15 and 16 are oppositely arranged at both sides of the paper web W. The knaggy rollers 15 and 16 include a plurality of convex contact surfaces 1*a* to 1*f* and 1*g* to 1*k*, respectively. The knaggy rollers 15 and 16 are rotatably supported by eccentric sleeves, not shown, through their shaft ends 15*a*, 15*b* and 16*a*, 16*b* and bearings, not shown.

The eccentric sleeves used in the third embodiment are driven in the same manner as the first embodiment shown in FIG. 1.

A typical operation of the printing system using the web width adjusting devices will be described in conjunction with FIG. 1 and FIG. 2.

The paper web W is set in the printing system shown in FIG. 2 in such a way that the web W is successively travelled through the printing sections P1, P2, P3, and P4 while passing between the first series of the contact surfaces 1*a* to 1*f* and the second series of the contact surfaces 1*g* to 1*k* of the web width adjusting devices 20.

After or prior to the above described work, required information on the paper web such as width, material, thickness, and the like are input into the control means 9 through the input means 10. The control means 9 outputs an actuating signal to the driving means 8 which drives the eccentric sleeves 4*a* to 4*d* with reference to the detected signal from the detecting means 13 so that the contact surfaces 1*a* to 1*k* are set at their initial positions predetermined in response to the web information.

Then a start switch, not shown, for the printing system is turned on to start travelling the paper web W and printing operation of the printing sections P1, P2, P3, and P4.

As the printing sections begin their rotational work, the detecting means 11 detects the rotating speed of the main motor 12, representing the travelling speed of the paper web W, and inputs the detected information to the control means 9. According to the information on the travelling speed of the paper web W corresponding to the rotating speed of the main motor 12, the control means 9 outputs an adjusting signal to shift the contact surfaces 1*a* to 1*k* from their initial positions to predetermined adjusting positions.

At the first printing section P1, the first image is printed on the paper web W and simultaneously blank sections of the printed web is supplied with dampening water through the blanket surface of the blanket cylinder BC. Thus wetted fibers of the paper web W become gradually extending in the width direction of the web W during travelling from the first printing section P1 to the succeeding printing section; i.e., second printing section P2. When the web W is passed through the web width adjusting device 20 prior to the second printing section P2, the web W is subjected to contacting pressures by the contact surfaces 1*a* to 1*k* so that the web W is deformed in a wavy surface WA. The wavy surface WA allows the primary width of the paper wave W to be decreased 11, 12.

Although the wavy surface WA gradually returns to its primary shape after passing the web width adjusting device 20, the web width can not be completely returned its primary width at the succeeding printing section (P2) and thus the paper web W with slightly smaller width than its primary width is entered into the succeeding printing section (P2). Therefore the extended width due to the dampening water at the proceding printing section (P1) may be cancelled by this shortened width. As a result, the paper web W without any faults such as visible wrinkels and the like is printed at the second printing section P2 so that the succeeding image can be printed and be consistent with the preceding image. On the same occasion, the blank section of the paper web is supplied with dampening water through the blanket surface of the blanket cylinder BC in the same manner as the first printing section P1.

Next, the paper web W is successively travelled to the succeeding printing section; i.e., the third printing section P3 through another web width adjusting device 20 arranged prior to the third printing section P3. In this web width adjusting device 20, the paper web W is also subjected to the same adjusting operation as the former adjusting means.

In each of the web width adjusting devices 20, the positions of the contact surfaces 1*a* to 1*k* against the paper web W should be adequately adjusted in response to the travelling speed of the paper web W because the wetted fibers will expand in proportion to time. In other words, the contact surfaces 1*a* to 1*k* should be largely shifted when the paper web W is travelled at a slow speed.

According to the web width adjusting device 20, the web width at the succeeding printing section can be adjusted to be consistent with that of the preceding printing section. Thus the image printed at the first to fourth printing sections P1 to P4 can be formed to be consistent with each other.

In experimental testing executed by the present applicant, a rolled newspaper type A (width 1626 mm) was used to clarify the difference between the effect obtained by utilizing web width adjusting device 20 arranged as shown in FIG. 2 and that of conventional press without any web width adjusting means. This experimental test evidenced that shears (about 2 mm) generated in the width direction between the first printed image and the fourth printed image line by conventional presses without adjusting devices can be wholly corrected by the web width adjusting device 20 according to the present invention. Although the expanding ratio in the web width depends on the type of paper web, the web width adjusting device according to the present invention can adequately compensate such shears in printing.

The automatic control means 9 may be replaced by manually control means.

The present invention is not limited to only the above described embodiments, and therefore for example the contact surfaces 1*a* to 1*k* of the web width adjusting device 20 may be modified in any adequate shapes and numbers. Further the control means 9 may be input with the information on the dampening water fed onto the web paper W at the printing sections P1 to P3; i.e., ratio between image and blank to be printed at the printing sections P1 to P3. Various changes and modifications are possible without departing from the spirit and claims of the invention.

As disclosed in the above description, since expansion in web width due to dampening can be adequately corrected by the web width adjusting device arranged between the preceding printing section and the succeeding printing section, the image printed at the succeeding printing section can be completely in accordance with the former image, thereby producing a high quality printed material without any shears and blurriness.

What is claimed is:

1. A printing apparatus through which a dampened paper web travels, said printing apparatus comprising:

first and second printing sections which each print an image on said dampened paper web as said dampened paper web travels through said first and second printing sections; and means for variably changing a width of said dampened paper web by forming said dampened paper web into a wavy surface so that said image formed on said dampened paper web at said first printing section and said image formed on said dampened paper web at said second printing section are properly aligned with each other, said changing means extending across an entire width of the paper web and being disposed between said first and second printing sections;

wherein said changing means includes first and second contact devices disposed at opposite first and second surfaces of said dampened paper web such that said dampened paper web travels between said first and second contact devices, said first and second contact devices respectively comprise first and second knaggy rollers, said first and second knaggy rollers respectively having a plurality of first and second contact members disposed thereon for rotation about same respective first and second shafts;

wherein each of said first and second knaggy rollers comprises a convex contact surface and a plurality of pairs of frustroconical members, each of said frustroconical members including a large end, and a small end; said convex contact surface being formed by placing the large end of one frustroconical member adjacent to the large end of another frustroconical member; and wherein said convex surfaces serve as said contact members.

2. A printing apparatus as recited in claim 1, wherein said plurality of first and second contact members extend along an axial direction such that such plurality of first contact members of said first contact device are staggered relative to said plurality of second contact members of said second contact device thereby producing an alternating sequence of individual first and second contact members as viewed along said axial direction.

3. A printing apparatus as recited in claim 1, further comprising a plurality of rotatable cylinders which drive said dampened paper web, said axis of rotation of each of said rotatable cylinders being approximately parallel to said axial direction.

4. A printing apparatus as recited in claim 1, wherein said changing means includes means for simultaneously moving all of said first plurality of contact members selectively into and out of contact with said first surface and for simultaneously moving all of said second plurality of contact members selectively into and out of contact with said second surface, and when said first and second plurality of contact members are in contact with said dampened paper web, said width of siad dampened paper web is reduced as compared to when said first and second pluarlity of contact members are not in contact with said dampened paper web.

5. A printing apparatus as recited in claim 4, further comprising means for controlling said moving means such that said width of said dampened paper web can be variably changed in response to an extent of movement of said first and second plurality of contact members into contact with said dampened paper web.

6. A printing apparatus as recited in claim 5, further comprising an input device through which information concerning the dampened paper web is provided to said controlling means, said information being used by said controlling means to determine said extent of movement.

7. A printing apparatus as recited in claim 6, wherein said convex contact surfaces on said first and second knaggy rollers are in elastic contact with said dampened paper web.

8. A printing apparatus as claimed in claim 2, wherein said alternating sequence is such that each of said second contact members is centered between two of said first contact members.

9. A printing apparatus as claimed in claim 8, wherein said alternating sequence is such that one of said second contact members is centered between every two of said first contact members.

10. A printing apparatus through which a dampened paper web travels, said printing apparatus comprising:

first and second printing sections which each print an image on said dampened paper web as said dampened paper web travels through said first and second printing sections;

means for variably changing a width of said dampened paper web so that said image formed on said dampened paper web at said first printing section and said image formed on said dampened paper web at said second printing section are properly aligned with each other, said changing means being disposed between said first and second printing sections;

wherein said changing means includes first and second contact devices disposed at opposite first and second surfaces of said dampened paper web such that said dampened paper web travels between said first and second contact devices, said first and second contact devices respectively having first and second knaggy rollers, said first and second knaggy roller respectively having a plurality of first and second contact members disposed thereon along an axial direction such that said plurality of first contact device members of said first contact device are staggered relative to said plurality of second contact members of said second contact device thereby producing an alternating sequence of individual first and second contact members as viewed along said axial direction;

further comprising a plurality of rotatable cylinders which drive said dampened paper web, said axis of rotation of end of said rotatable cylinders being approximately parallel to said axial direction;

wherein said changing means includes means for moving said first plurality of contact members into and out of contact with said first surface and for moving said second plurality of contact members into and out of contact with said second surface, and when said first and second plurality of contact members are in contact with said dampened paper web, said width of said dampened paper web is reduced as compared to when said first and second plurality of contact members are not in contact with said dampened paper web;

further comprising means for controlling said moving means such that said width of said dampened paper web can be variably changed in response to an extent of movement of said first and second plurality of contact members into contact with said dampened paper web;

further comprising an input device through which information concerning the dampened paper web is provided to said controlling means, said information being used by said controlling means to determine said extent of movement;

wherein each of said first and second knaggy rollers comprises a convex contact surface and a plurality of pairs of frustroconical members, each of said frustroconical members including a large end, and a small end; said convex contact surface being formed by placing the large end of one frustroconical member adjacent to the large end of another frustroconical member;

wherein the convex contact surfaces provided on each of the first and second knaggy rollers serve as said first and second plurality of contact members and each of said convex contact surfaces provided on said first and second knaggy rollers are in elastic contact with said dampened paper web; and wherein said first contact device includes a first shaft on which said first knaggy roller is mounted, said second contact device includes a second shaft on which said second knaggy roller is mounted, and said changing means further includes first, second, third and fourth rotatable members each having a sleeve projecting from a surface thereof at an eccentric position relative to an axis of rotation of said rotatable member, first and second ends of said first shaft are respectively disposed in said sleeves of said first and second rotatable members and first and second ends of said second shaft are respectively disposed in said sleeves of said third and fourth rotatable members.

11. A printing apparatus as recited in claim 10, wherein said moving means includes a gear system and a drive unit connected to said gear system, and wherein when said gear system is driven by said drive unit said first, second, third and fourth rotatable members are forced into rotation whereby said extent of movement of said first and second plurality of contact members into contact with said dampened paper web is varied.

12. A printing apparatus as recited in claim 11, further comprising a detector for sensing a travelling speed of said dampened paper web and for providing a signal indicative of said travelling speed to said controlling means, said controlling means utilizing said signal to control said extent of movement.

13. A method of printing on a paper web having planar printing surfaces and travelling through a printing apparatus, the method comprising the steps of:

vertically arranging a first printing station above a second printing station;

dampening the paper web thereby causing an expansion of the paper web in a width direction;

forming an initial image on the paper web by passing the paper web through a first printing station; then compensating for the paper web expansion, in order to ensure that a subsequently formed image produced on the paper web is aligned with the initial image, by bringing a separate convex contact surface of first and second knaggy rollers that serves as a contact member into contact with opposite surfaces of the dampened paper web thereby changing the planar printing surfaces of the dampened paper web into a wave shaped surface and correspondingly reducing the width of the dampened paper web;

wherein each first and second knaggy roller comprises a plurality of pairs of frustroconical members, each of said frustroconical members including large end, and a small end; said convex contact surface being formed by placing the large end of one frustroconical member adjacent to the large end of another frustroconical members; then forming the subsequent image on the paper web by passing the paper web through a second printing station.

14. The method of claim 13, including the step of providing the first knaggy roller with a plurality of first convex contact surfaces at regular intervals across the width direction of the paper web, and providing the second knaggy roller with a plurality of second convex contact surfaces at regular intervals, alternating with the intervals of the first members, across the width direction of the paper web.

15. The method of claim 14, wherein the providing step includes providing the plurality of second surfaces so that each of said second convex contact surfaces is centered between two of said first convex contact surfaces.

16. The method of claim 15, wherein the providing step includes providing the plurality of second surfaces so that one of said second convex contact surfaces is centered between every two of said first convex contact surface.

17. The method of claim 14, wherein the compensating step includes adjusting simultaneously a degree of contact of all the first and second convex contact surfaces with the opposite surfaces of the dampened paper web.

18. The method of claim 14, including the step of mounting each of said shafts in respective eccentric sleeves.

19. The method of claim 13, including the step of mounting said first knaggy roller and said second knaggy roller, respectively, on a first shaft and a second shaft.

* * * * *